US005209404A

United States Patent [19]

Jun

[11] Patent Number: 5,209,404

[45] Date of Patent: May 11, 1993

[54] SPEED ADJUSTMENT DEVICE FOR A SPLATTER ARM IN A GARDEN SPRINKLER

[75] Inventor: Mei-Be Jun, Changhua Hsien, Taiwan

[73] Assignee: Ting Yang Enterprise Co., Ltd., Changhua Hsien, Taiwan

[21] Appl. No.: 904,268

[22] Filed: Jun. 25, 1992

[51] Int. Cl.[5] ..... B05B 3/14

[52] U.S. Cl. ..... 239/230; 239/233

[58] Field of Search ..... 239/230, 231, 233, 237, 239/DIG. 1

[56] References Cited

U.S. PATENT DOCUMENTS

| | | | |
|---|---|---|---|
| 3,009,650 | 11/1961 | Alvarez | 239/233 |
| 4,103,828 | 8/1978 | Ridgway | 239/230 |
| 4,162,038 | 7/1979 | Ridgway | 239/230 |
| 4,173,306 | 11/1979 | Ridgway | 239/230 |

*Primary Examiner*—Andres Kashnikow

*Assistant Examiner*—Christopher G. Trainor

*Attorney, Agent, or Firm*—Bacon & Thomas

[57] ABSTRACT

A novel speed adjustment device for control of the operation frequency of the splatter arm in a sprinkler adapted for watering a garden or a lawn. The speed adjustment device is provided with an adjustment knob which is disposed on top of a bias spring in connection to the splatter arm at one end and to the underside of the adjustment knob at the other end, and an urging spring is disposed on top of the adjustment knob so as to always urge the same downward. The underside of the adjustment knob is provided with a plurality of spaced stop protrusions which are in selective engagement with a pair of stop members disposed on the rotatable main body of the sprinkler so that the turning of the adjustment knob can vary the tension of the bias spring in connection to the splatter arm thereby the operation frequency thereof can be changed accordingly.

1 Claim, 2 Drawing Sheets

SPEED ADJUSTMENT DEVICE FOR A SPLATTER ARM IN A GARDEN SPRINKLER

BACKGROUND OF THE INVENTION

1. Field of the Invention

The present invention relates to a novel speed adjustment device adapted for a sprinkler used to water gardens and lawns, which can vary the operation frequency of the splatter arm of a sprinkler so as to make the water sprinkled in a more even and effective manner.

2. Description of the Prior Art

As shown in FIG. 1, the prior art sprinkler adapted for watering gardens and lawns is equipped with a securing base 10 coupled to a water source pipe with a rotatable body 11 mounted thereon; and a limiting stick 12 used to adjust the angle of rotation of the rotatable body 11; and a water discharging hole communicating with the securing base 10; a pivotal splatter arm 13 pivotally mounted to the body 11 with the front end thereof disposed at a distance from the water discharging hole; and a bias spring 14 connecting the splatter arm 13 to the rotatable body 11; and some means to make the rotatable body spin whereby the pivotal splatter arm 13 actuated by the bias spring 14 and the pressure of the discharged water can be pivoted back and forth and make the discharged water sprinkled.

This prior sprinkler can operate in a good manner but the pivotal splatter arm works only at a fixed frequency, because of the tension of the bias spring being invariable, making the sprinkling effect less satisfactory.

SUMMARY OF THE INVENTION

Therefore, the primary object of the present invention is to provide a novel speed adjustment device for a splatter arm in a garden sprinkler so that the operation frequency of the pivotal splatter arm can be varied accordingly.

Another object of the present invention is to provide a speed adjustment device for a splatter arm in a garden sprinkler which is provided with an adjustment knob having a plurality of spaced stop protrusions disposed on the periphery of the underside thereof which are in selective engagement with a pair of stop members; the adjustment knob is downward urged by an urging spring disposed on top thereof so as to make the stop protrusions always engage with the stop members, and the bias spring is coupled to the underside of the adjustment knob at one end and to the pivotal splatter arm at the other end thereby the turning of the adjustment knob can vary the operaion frequency of the springkler accordingly.

DETAILED DESCRIPTION OF THE PREFERRED EMBODIMENTS

Figure 1:
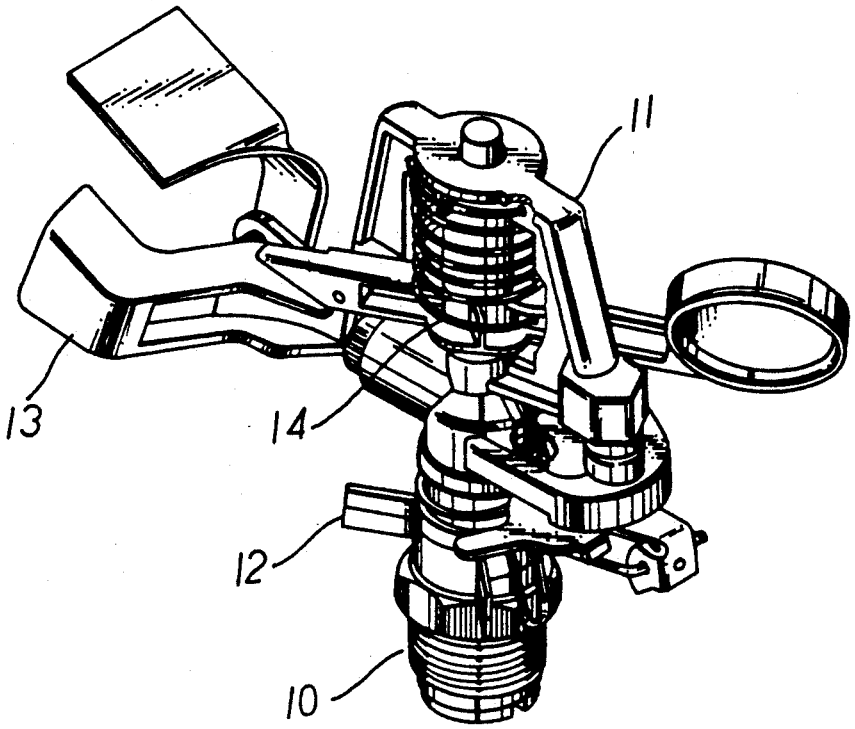
FIG. 1 (PRIOR ART)
FIG. 1 is a diagram showing a prior art sprinkler.
Figure 2:
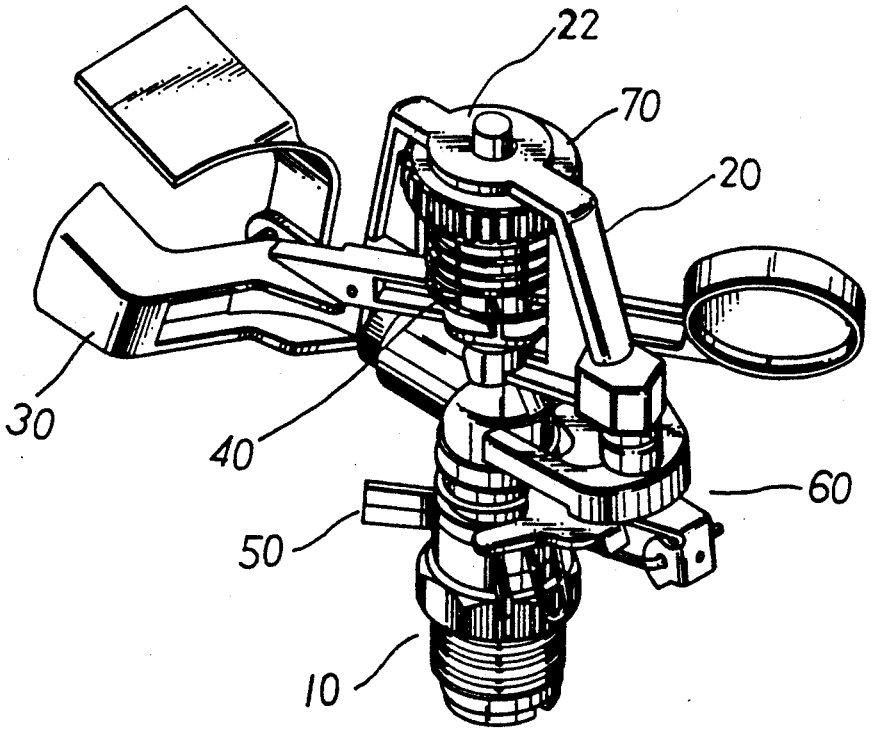
FIG. 2 is a perspective view of the embodiment of the present invention.
Figure 3:
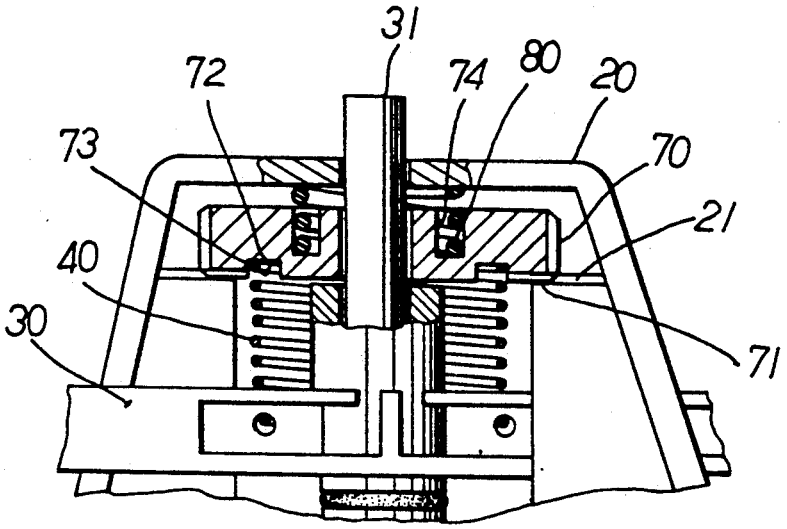
FIG. 3 is a sectional view of the adjustment knob in engagement with the stop members.
Figure 4:
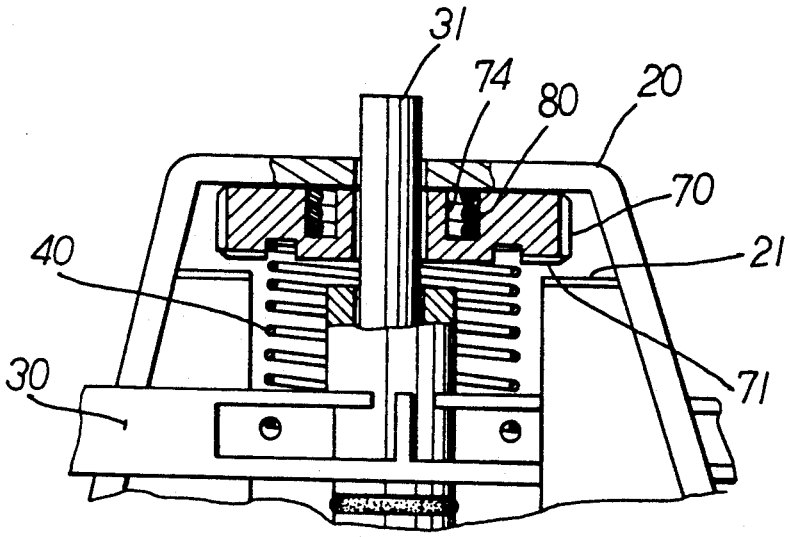
FIG. 4 is a sectional view of the adjustment knob out of the engagement with the stop members, permitting the same to be turned.

Referring to FIGS. 2, 3, the speed adjustment device of the present invention is mounted to a sprinkler comprised of a base 10, a rotatable main body 20, a pivotal splatter arm 30, a bias spring 40, a rotation angle limiting stop 50, and swivel control means 60 and etc. On the top of the main body 20 and to the pivot axis 31 of the splatter arm 30 is secured an adjustment knob 70 having a plurality of equally spaced gear-like protrusions disposed on the outer periphery thereof. The periphery of the underside of the adjuatment knob 70 is provided with a plurality of spaced stop protrusions 71. Inwardly, and beyond the stop protrusions 71, is disposed a first peripheral groove 72 on the underside of the adjustment knob 70 and a fixing groove 73 is disposed inside the peripheral groove 72 for the securing of one end of the bias spring 40 which is coupled to the splatter arm 30 at the other end.

A second peripheral groove 74 is disposed on the top side of the adjustment knob 70 with an urging spring 80 disposed inside thereof; the urging spring 80 is in abutment against the under surface of the the top 22 of the rotatable main body so as to exert a force urging the adjustment knob downward thereby the stop protrusions 71 can always engage with a pair of stop members 21 disposed on the rotatable main body 20 and under the adjustment knob 70. The adjustment knob 70 is located under the top 22 of the rotatable main body 20 with a space left therebetween so that the adjustment knob 70 is able to be pushed upward, taking the stop protrusions 71 out of engagement with the stop members 21 for turning of the same.

To ensure that the adjustment knob 70 can be firmly held in place by the urging spring 80, the force applied by the urging spring 80 must always be larger than the tension generated by the bias spring 40 whereby the stop protrusions 71 can be in engagement with the two stop members 21 when no external force is applied to the adjustment knob 70.

Figure 5:
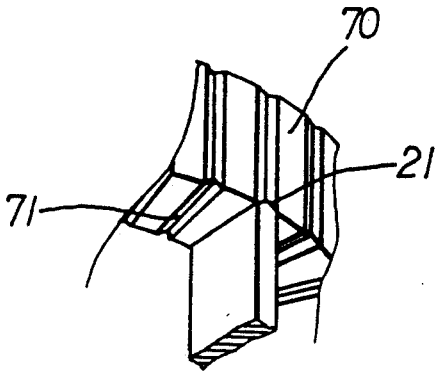
FIG. 5 is a diagram showing an enlarged detail of the stop protrusions in engagement with the stop member.

One end of the bias spring 40 is secured to the adjustment knob 70 and the other end is coupled to the splatter arm 30, as proceedingly described, to vary the tension of the bias spring 40, the adjustment knob 70 must be lifted up, making the stop protrusions 71 out of engagement with the two stop members 21, and then be turned in either direction so as to increase or decrease the tension of the bias spring 40 accordingly. Afterwards, the adjustment knob 70 is released, and the urging spring 80 will force the adjustment knob 70 downward, making the stop protrusions 71 engaged with the stop members 21, as shown in FIG. 5, so as to prevent the adjustment knob 70 from spinning. Thus, the operation frequency of the splatter arm 30 can be correspondingly changed as desired.

The splatter arm 30 is elastically held by the bias spring 40 at one end and is forced to pivot away by the discharged water at the other end; by varying the tension of the bias spring 40, the pivot span of the splatter arm 30 and the frequency thereof are accordingly changed. The larger the tension of the bias spring is, the higher the operation frequency of the splatter arm 30 becomes, and a smaller tension of the bias spring 40 will result in a lower operation frequency of the splatter arm 30.

In summary, the present invention permits a prior art sprinkler operating at a fixed frequency to be adjustable in its operation frequency so as to make the present sprinkler operate in a more versatile and efficient manner.

I claim:

1. The A speed adjustment device for control of the operation frequency of a splatter arm in a garden sprinkler, comprising:

a sprinkler means having a rotatable main body, a pivotal splatter arm, a bias spring, a rotation angle limiting stop, a swivel control means and a pivot axis to which is secured the pivotal splatter arm; and an adjustment knob having a plurality of spaced stop protrusions disposed on the underside thereof; and a first peripheral groove adjacent to said stop protrusions being disposed on the underside of said adjustment knob for receiving the top of said bias spring; and a fixing groove being disposed inside of said first peripheral groove for securing one end of said bias spring; and a second peripheral groove being disposed on the top side of said adjustment knob for receiving an urging spring;

said urging spring being in abutment against the top of said rotatable main body at one end and in abutment against said adjustment knob at the other end so as to urge said adjustment knob downward;

a pair of stop members disposed right under said adjustment knob and being located on said rotatable main body so as to permit said plurality of spaced stop protrusions to be in selective engagement with said stop members, thereby said adjustment knob can be held in place with respect to the main body without turning;

said splatter arm being connected to said bias spring and being able to be forced to pivot by the discharged water from said main body;

said bias spring being connected to said adjustment knob at one end and to said splatter arm at the other end so that turning the adjustment knob can vary the tension of said bias spring and make the pivot span and operation frequency of said splatter arm changed accordingly.

* * * * *